United States Patent [19]

Willem

[11] 3,964,536

[45] June 22, 1976

[54] METHOD FOR FIXING A METALLIC ARMATURE OF A NON-METALLIC PART

[75] Inventor: Michel Willem, Cusset, France

[73] Assignee: Ceraver, Paris, France

[22] Filed: Dec. 11, 1973

[21] Appl. No.: 423,825

[30] Foreign Application Priority Data

Dec. 12, 1972 France ..... 72.44170

[52] U.S. Cl. ..... 164/98; 29/631

[51] Int. Cl.[2] ..... B22D 19/00

[58] Field of Search ..... 164/98, 100, 101, 75, 164/107; 29/631; 228/122, 214, 123

[56] References Cited

FOREIGN PATENTS OR APPLICATIONS

| | | |
|---|---|---|
| 634,580 | 11/1927 | France |
| 448,956 | 9/1927 | Germany |
| 456,051 | 2/1928 | Germany |
| 378,474 | 7/1923 | Germany |
| 310,222 | 4/1929 | United Kingdom |
| 347,930 | 5/1931 | United Kingdom |

*Primary Examiner*—Ronald J. Shore
*Assistant Examiner*—Gus T. Hampilos
*Attorney, Agent, or Firm*—Sughrue, Rothwell, Mion, Zinn & Macpeak

[57] ABSTRACT

Method for fixing a connecting cap (4) on a non-metallic part (1) by moulding of the metal or alloy of the connecting cap in the melted state on the adherence bearing surface of the non-metallic part. One or several metallic parts closely applied, more particularly a sleeve (2) or a ring, is arranged at least on a part of that adherence bearing surface.

2 Claims, 6 Drawing Figures

METHOD FOR FIXING A METALLIC ARMATURE OF A NON-METALLIC PART

The present invention concerns a method for fixing a metallic connecting cap on a non-metallic part by moulding the metal or alloy of the connecting cap in the melted state on the adherence bearing surface of the non-metallic part. The non-metallic part may be, for exampe, an insulating part made of a ceramic substance: glass, procelain, etc., of an electric insulator. It concerns also a device for implementing that method and the objects produced by that method.

Such a method was the object of French Pat. No. 1 253 881 of 5 Jan. 1960 for the manufacturing of suspension insulators. The difficulties in setting have, however, been such that it does not seem that industrial production has been developed, except by the assignee of the, which has commercialised on a large scale a production of suspension insulators of the cap and rod type whose insulating part is a tempered glass plate provided with an adherence bearing surface on which is moulded directly a cap made of zinc, aluminium, and magnesium alloy whose melting temperature is close to 380° C, such as that sold under the trade mark "Zamak".

Despite particular precautions, such as the coating of the adherence bearing surface with a layer of heat insulating substance previous to the moulding, that method has not enabled up till now the fixing of the metallic connecting cap on a non-metallic part when the metal or alloy had a relatively high melting point, for example about 650° C or more, especially when the non-metallic part was made of a substance sensitive to heat shocks, such as tempered or non-tempered glass, electrotechnical porcelain, ceramic, oxide or compound substance, etc.

The aim of the present invention is to overcome the limitations of the above method and to enable the fixing of a metallic armature on a non-metallic part which may be of very diverse nature and even sensitive to heat shocks by implementing metals or alloys melting at a relatively high temperature. However, it also applies in the case of alloys melting at lower temperatures and confers thereon a greater ease of production.

The method according to the invention is characterised in that one or several metallic parts are arranged closely applied on a part of the adherence bearing surface of the non-metallic part.

It comprises, moreover, preferably at least one of the following characteristics:

The metallic part is in the form of a metal sleeve made of a metal which is a good conductor of heat, crimped on the adherence bearing surface;

The metallic part is in the form of a ring;

A sleeve and a ring are arranged simultaneously on the adherence bearing surface;

The ring is constituted by the same metal or alloy as that of the connecting cap;

The ring fufills the function of a seal between the mould and the non-metallic part, thus limiting the moulding volume;

The ring is itself formed by moulding, previously to the moulding of the connecting cap;

The ring is moulded at the same time as the connecting cap of a non-metallic part, then separated from the latter and arranged on a non-metallic part for a subsequent moulding operation;

The edge of the sleeve is in the form of a flange intended for forming the seal between the mould and the non-metallic part;

The sleeve is applied to the adherence bearing surface by the moulding pressure.

The device according to the invention is characterised in that it comprises a mould covering the adherence bearing surface of the mon-metallic part, that bearing surface constituting a core of the mould, a seal between the adherence bearing surface and the mould limiting the moulding volume, and one or more metallic parts closely applied at least to one part of the adherence bearing surface. Preferably, the mould comprises two cavities, the one corresponding to the volume of the connecting cap to be fixed, the other corresponding to that of a ring intended for forming a seal between the mould and the adherence bearing surface.

Various fixing means for metallic armatures on electric insulators are described herebelow, by way of examples and with reference to the accompanying drawing.

The FIG. 1 shows an axial cross-section view of a cap and rod type insulator, in which a metallic sleeve is arranged on the adherence head.

Figure 1:
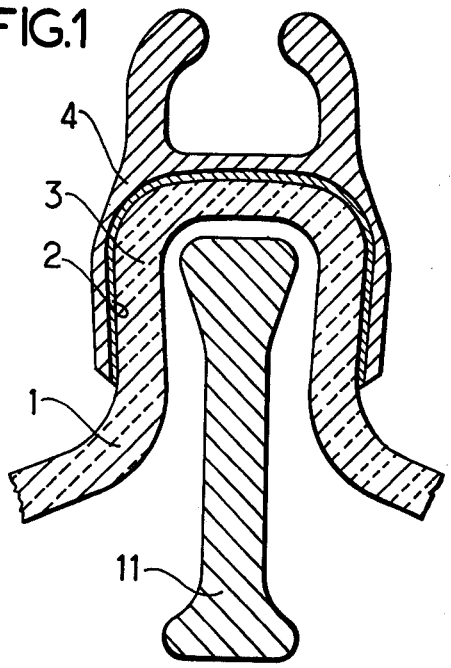

The insulator shown in FIG. 1 is constituted by a plate 1 made of ceramic (tempered glass, for example) arranged on the head of rod 11. A metallic sleeve 2 which is not very thick and may easily be deformed, crimped closely to the head 3 of the plate by electromagnetic pressing or any other equivalent means, is arranged on the plate 1.

The body 1 fitted with the sleeve 2 is inserted in a mould (not shown) providing, between the inner walls of the mould, the outer surface of the sleeve 2, and a seal between the mould and the body 1, a volume corresponding to the cap 4 obtained by moulding under pressure the melted metal or alloy in the volume previously defined. The sleeve 2 prevents the direct arrival of the melting mass onto the ceramic substance and consequently reduces the thermal shock, which is particularly dangerous at the point where the cast metal reaches, in the first place, the ceramic substance. The metallic sleeve 2 in contact with the cast metal jet heats up, but distributes, by its good conductivity, that heating throughout the whole surface of the head 3 and damps the local thermal stresses. During the cooling of the melted mass, the shrinkage phenomenon causes compression effects in the head 3. These compression effects are generally favourable, on condition that they be maintained within controlled limits. The presence of the sleeve 2, whose nature and dimensions may be modified, makes that controlling easier.

The absence of adherence between the sleeve 2 and the head 3 makes easier the relative sliding and avoids localised tearing effects. The possibility of sliding of the sleeve 2, more particularly in the zone 5 corresponding to the edge of the cap 4, enables a certain flowage of the substance of the sleeve 2 and contributes to providing in that zone a moderate compression gradient between the highly stressed part of the head 3 and the part of the body 1 which is not affected.

Just as it is recommended to provide, in the zone 5, a moderate mechanical stress gradient, it is also recommended to provide, during the moulding, a moderate temperature gradient in that same zone between the head 3 heated by the melting mass and the flat non-heated part of the body 1. It is naturally possible to decrease the difference in temperature between these two parts by a previous heating of the plate. Nevertheless, it is obviously impossible to bring the temperature of the plate to the same temperature as that of the head--namely, 600° C or more. To produce this moderate temperature gradient, a metallic part, fulfilling the function of a calory absorber and a radiator, is arranged in that zone.

Figure 2:
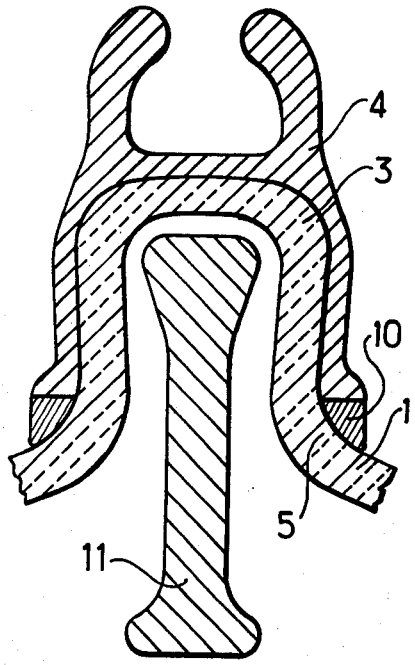
FIG. 2 shows an axial cross-section view of a cap and rod type insulator, in which a metallic ring is arranged on the adherence head.

That part is shown at 10 in FIG. 2 in contact with the zone 5 of the body 1 between the head 3 heated by the melted metal and the non-heated flat part. It is constituted by an annular metallic ring which can fulfill the function of a seal between the mould and the plate. It could be an advantage to constitute that ring with the same substance as that of the cap 4; thus, the melting mass will be locally cooled by heat conductivity from the melting mass to the mass of the ring, but also, occasionnally, by the melting heat of the part of the ring 10 in contact with that melting mass, which part itself will have melted.

That arrangement is a particular advantage when the edge of the cap 4 comprises a toroidal reinforcing part and consequently an accumulation of localised energy to be dissipated, as is shown in FIG. 2.

When the ring 10 is constituted of the same material substance as the cap 4, it is an advantage to manufacture it, according to another aspect of the invention, in the same moulding operation as that of the cap 4. In this situation, the mould must comprise, besides the moulding volume corresponding to the cap 4, a moulding volume corresponding to the ring 10, supplied by a moulding connection orifice which is sufficiently thin for the separation of the ring 10 from the cap 4 to be effected easily. Thus, the moulding of the ring 10 constituting the seal for a following moulding operation may be effected at each moulding operation for the cap 4. As the two operations are effected in an almost equivalent time, (that is, the second following the first very closely) there is no danger of surface etching by oxidation, for example, disturbing any connection by melting of the two parts, the cap 4 and the ring 10.

Figure 5:
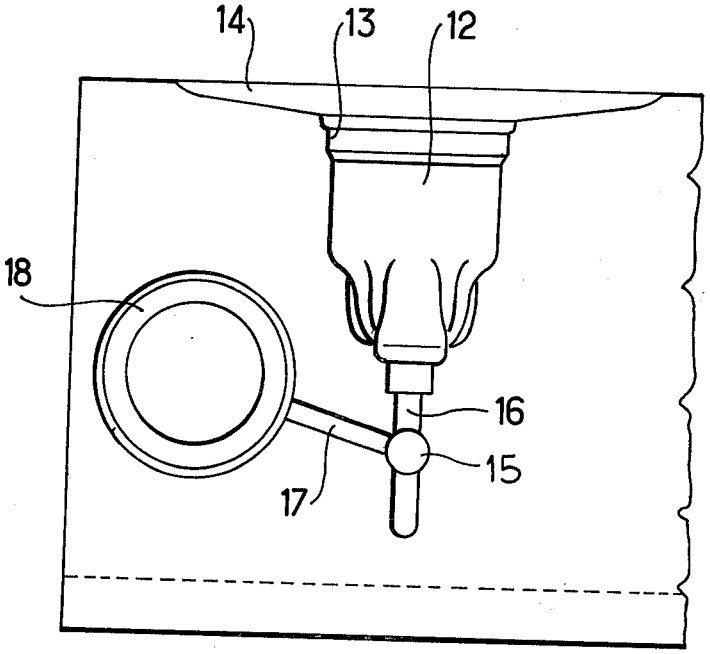
FIG. 5 shows a mould suitable for producing both a cap and a sealing ring in the same operation.

A mould suitable for producing both the cap 4 and the seal ring 10 in the same moulding operation is shown in FIG. 5. It comprises a first moulding volume 12 corresponding to the body 1, a second moulding volume 18 corresponding to the ring 10, a circular hollow 14 for the insertion of the insulator (i.e., the body 1) on which the connecting cap 4 is to be cast, and a common casting channel 15 which divides into two separate casting channels 16 and 17, which feed the moulding volumes 12 and 18, respectively. The edge 13 of the moulding volume 12 is shaped to receive a previously produced ring 10 before each moulding operation.

Figure 6:
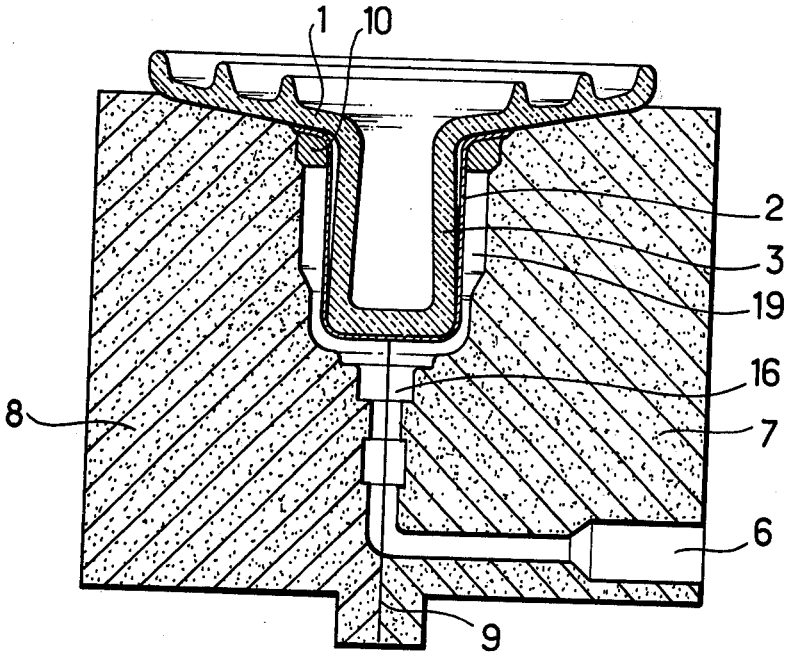
FIG. 6 shows the mould of FIG. 5 ready for operation.

FIG. 6 shows the mould of FIG. 5 ready for operation, with the body 1 (consisting of a ceramic insulator) and the previously produced ring 10 in position. The mould comprises two parts 7 and 8 assembled along a contact surface 9. The moulding volume 18 for the ring 10 is not seen in this figure because it is above the lane of the section. When the molten metal is cast through opening 6 into casting channel 15, it fills the volume 19 around the metallic sleeve 2 up to the seal ring 10 to form the metallic connecting cap 4, while simultaneously filling the moulding volume 18 to form a new seal ring 10.

Figure 3:
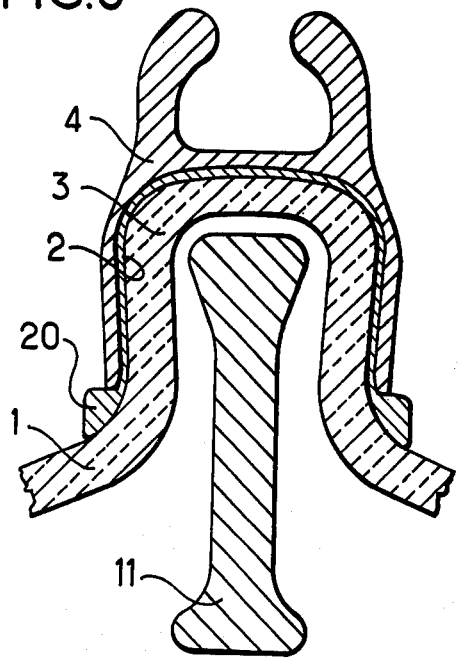
FIG. 3 shows an axial cross-section view of a cap and rod type insulator, in which the edge of the metallic sleeve is in the form of a flange.

It is possible to constitute the sleeve 2 in such a way that it comprises a flange 20, FIG. 3, which may act as a seal between the mould and the plate.

In these conditions, it may be useless to subject the sleeve 2, after insertion on the head 3, to an electromagnetic crimping operation; the crimping may be effected by the pressure moulding operation itself.

Figure 4:
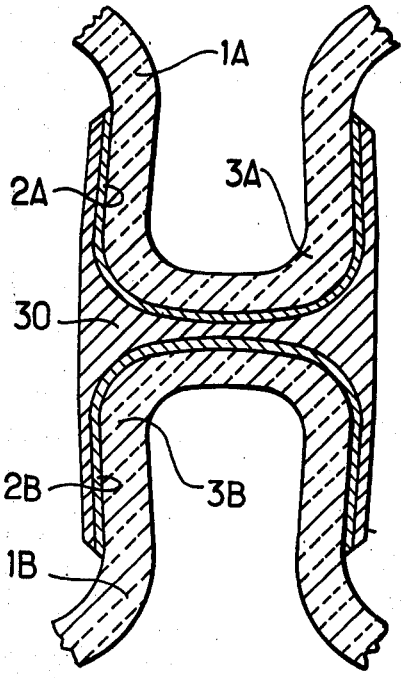
FIG. 4 shows an axial cross-section view of a cap and rod type insulator having two insulating plates connected together head to tail.

Although the preceding examples describe only the cap and rod type insulation means, it is quite evident that the method applies, whatever the form and the destination of the connecting caps to be produced may be. Thus, in the field of insulators, it can be applied for producing a connecting cap for two insulating bodies connected up together head to tail, as shown at 30 in FIG. 4. The two plates 1A, 1B whose adherence heads 3A, 3B are each covered by their sleeves 2A, 2B, are arranged in a mould in two parts suitably stopped up at each end by appropriate seals. After moulding, an insulating element assembled by the bush 30 is obtained.

Such a method may, to great advantage, be applied to the producing of insulators according to French Pat. Nos. 1 276 071 and addition 88 768, 1 276 072 and addition 88 769, 2 092 666, 2 088 172, 2 036 197, and 1 595 454. In these embodiments, instead of arranging a sleeve on each adherence head of the insulating bodies, it is evident that it is just as possible to use a single sleeve having an appropriate shape, cylindrical or profiled by the embossing method, for example.

It is quite evident also that the method described may be applied to the fixing of metallic connecting caps to any objects other than insulators whatever their form and destination may be.

Although the fixing methods and devices for a metallic connecting cap on a non-metallic part which have been described hereinabove may appear to be preferable, it will be understood that various modifications may be made thereto without going beyond the scope of the invention, it being possible to replace certain operations or certain parts by others which would fulfill the same technical function therein.

I claim:

1. A method of fixing a metallic connecting cap of an electrical insulator of the rod-and-cap type on a non-metallic part, said metallic connecting cap comprising a lower part to be fitted around the nonmetallic dielectric part and an upper part containing a cavity for receiving the lower part of a rod, said method comprising the steps of:

1. Closely applying a first thin metallic part a. to at least a part of the outer surface of said nonmetallic dielectric part on which said lower part of a first metallic connecting cap is to be fixed, b. Which is in the form of a sleeve made of a metal which is a good conductor of heat, c. which is crimped on the surface of said non-metallic dielectric part on which said first metallic connecting cap is to be fixed, and d. the edge of which is in the form of a flange which functions as a seal between the mould and said nonmetallic dielectric part, thus limiting the mould volume, and

2. moulding said first metallic connecting cap on said first thin metallic part while the material of which said first metallic connecting cap is to be composed is in the melted state.

2. A method as claimed in claim 1 wherein said first thin metallic dielectric part is applied to the surface of said non-metallic part by moulding pressure.

* * * * *